US010350648B2

(12) United States Patent
Gross et al.

(10) Patent No.: US 10,350,648 B2
(45) Date of Patent: Jul. 16, 2019

(54) MAT CLEANING AND DRYING APPARATUS AND METHOD

(71) Applicants: 0959690 B.C. LTD., Langley (CA); Robert Mark Gross, Piney (CA)

(72) Inventors: Robert Mark Gross, Piney (CA); Kim Caron, Cochrane (CA)

(73) Assignee: 0959690 B.C. LTD., Langley (CA)

( * ) Notice: Subject to any disclaimer, the term of this patent is extended or adjusted under 35 U.S.C. 154(b) by 201 days.

(21) Appl. No.: 15/142,862

(22) Filed: Apr. 29, 2016

(65) Prior Publication Data

US 2017/0036248 A1 Feb. 9, 2017

Related U.S. Application Data

(60) Provisional application No. 62/201,939, filed on Aug. 6, 2015.

(51) Int. Cl.

| | |
|---|---|
| ***B08B 1/02*** | (2006.01) |
| ***B08B 3/02*** | (2006.01) |
| ***B08B 5/02*** | (2006.01) |
| *B08B 5/04* | (2006.01) |

(52) U.S. Cl.

CPC ..... *B08B 3/022* (2013.01); *B08B 5/023* (2013.01); *B08B 5/026* (2013.01); *B08B 5/043* (2013.01)

(58) Field of Classification Search

CPC ..... B08B 3/022; B08B 3/123; B08B 1/02; B08B 5/023; B08B 5/026

See application file for complete search history.

(56) References Cited

U.S. PATENT DOCUMENTS

| | | | | |
|---|---|---|---|---|
| 1,723,514 A * | 8/1929 | Klein | D06B 5/08 15/40 |
| 3,518,710 A | 7/1970 | Heilman | |
| 3,574,526 A | 4/1971 | Bell | |
| 3,589,147 A * | 6/1971 | Price, Jr. | D06B 1/08 68/125 |
| 4,083,206 A * | 4/1978 | Lemon | D06F 31/00 134/60 |
| 4,095,443 A * | 6/1978 | Hasselschwert | D06G 1/00 210/522 |

(Continued)

FOREIGN PATENT DOCUMENTS

| | | |
|---|---|---|
| FR | 2233808 | 10/1975 |
| WO | 2009/155429 | 12/2009 |

*Primary Examiner* — Joseph L. Perrin
*Assistant Examiner* — Irina Graf
(74) *Attorney, Agent, or Firm* — Parlee McClaws LLP; Susan Rancourt

(57) ABSTRACT

An apparatus for washing a mat, which enables a user to introduce the mat into the apparatus pile side up so, that it can be inspected and pretreated before cleaning by the apparatus. The mat is inclined in the wash and/or rinse module of the apparatus, while a plurality of high pressure nozzles spray water onto the pile side of the mat. Water flowing down the inclined mat pre-wets regions of the mat to pre-treat these regions before they are treated by the high pressure nozzles. The apparatus may include a trough at the bottom of the incline to further soak the mat before treatment by the high pressure nozzles. The apparatus may include means for holding the mat flat on the incline, means for extracting water from the cleaned mat, and means for cleaning and reusing water.

14 Claims, 15 Drawing Sheets

(56) References Cited

U.S. PATENT DOCUMENTS

| | | | | |
|---|---|---|---|---|
| 4,103,389 | A | 8/1978 | Resnick et al. | |
| 4,104,755 | A | 8/1978 | Smith | |
| 4,226,641 | A | 10/1980 | Bode, Sr. et al. | |
| 4,268,929 | A | 5/1981 | Sorensen et al. | |
| 4,327,756 | A * | 5/1982 | Rath | A47L 15/245 134/152 |
| 4,453,386 | A * | 6/1984 | Wilkins | D06G 1/00 68/19.1 |
| 2002/0031636 | A1* | 3/2002 | Brown | D06G 1/00 428/95 |
| 2010/0051058 | A1 | 3/2010 | Cotter et al. | |
| 2011/0017245 | A1* | 1/2011 | Vernon | B08B 1/005 134/122 R |
| 2011/0108070 | A1* | 5/2011 | Kunnas | B08B 1/02 134/32 |

* cited by examiner

MAT CLEANING AND DRYING APPARATUS AND METHOD

FIELD

This disclosure relates to an apparatus and method for cleaning and drying mats.

BACKGROUND

Typically floor mats comprise a pile or nap side attached to a rubber or vinyl backing sheet. Various types of machines are known for cleaning such floor mats. WO 2009/155429 describes one such cleaning system. In WO 2009/155429, the cleaning system comprises various modules and the mat to be washed is conveyed sequentially through the various modules on a conveyor. The mat is subjected to different cleaning operations in the various modules. In this cleaning system, the mat is conveyed through the system in a substantially horizontal plane, typically with the pile side of the mat facing down. The mat is first conveyed to a vibration module where any dirt present in or on the mat is dislodged from it. After traveling through the vibration module, the mat enters a washing module. In this module, the mat is washed and rinsed with low pressure or high pressure water. Water used in the washing module may be recycled for reuse. The mat then proceeds to a drying module to remove moisture from the mat. In one embodiment, the dryer module comprises one or more of the following: a cool air dryer, a high-volume, low-pressure dryer, a heated low velocity dryer, and a hot air dry. In one embodiment, after exiting the drying module, the mat is fed into an auto-roll discharge module. Such a discharge apparatus rolls the mat as it goes through this module.

The disclosure of WO 2009/155429 is typical of many mat washing machines, which wash a mat with the pile side down, so that dirt in the mat will fall out of the mat by gravity. Other examples of machines which wash a mat pile side down are found in: U.S. Pat. Nos. 4,103,389, 3,518,710, FR 2,233,808, U.S. Pat. Nos. 3,574,526, 4,453,386, 4,268,929 and U.S. Pat. No. 4,226,641.

However, by introducing a mat into the machine pile side down, operators are not able to see rips and tears in the matting that need to be repaired, or to see areas of the mat that are in need of deeper cleaning, or spot cleaning, with the result that the mat may not be satisfactorily cleaned. To try clean these areas the user may choose to run the mat through the machine again, which is costly and time consuming. It would be desirable to have a machine which enables users to detect the areas on a mat that are in need of deeper or spot cleaning, so that during the wash process these areas can be targeted, avoiding the need to re-clean the mat or settle for a mat that is not satisfactorily cleaned.

SUMMARY

Figure 1:
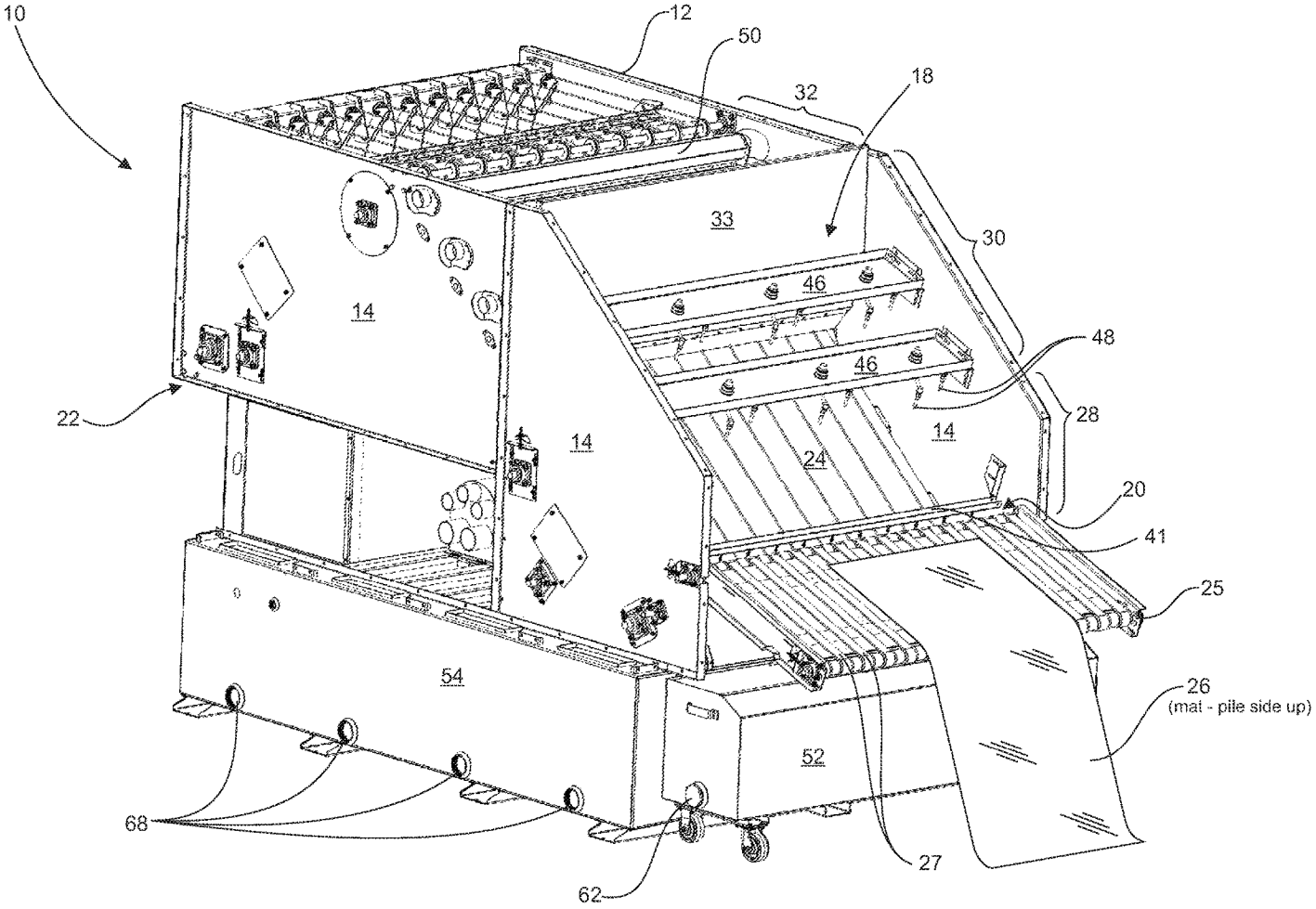
FIG. 1 is a side perspective view of a mat cleaning and drying apparatus according to one embodiment.

A mat cleaning apparatus and method that enables a user to introduce the mat into the apparatus with the pile side up, thereby allowing the user to perform a quality inspection and/or pre-treat the mat before it is cleaned by the apparatus. The apparatus has three basic components—a prewash module, a wash and/or rinse module and an extraction module. These three modules may be supplemented by additional components.

In one aspect, described herein is an apparatus for washing a mat having a pile side and a backing comprising:

a) a housing having opposing sidewalls, a front end wall, a rear end wall, an entrance in the front end wall for receiving the mat pile side up and an exit in the rear end wall;

b) a conveying means for moving the mat through the apparatus;

c) said conveying means extending from the entrance to a prewash module, a wash and/or rinse module, an extraction module and the exit;

d) said conveying means having an incline in at least a part of the wash and/or rinse module, and e) said wash and/or rinse module comprising a plurality of high pressure nozzles positioned to spray water onto the pile side of the mat when the mat is on the incline of the conveying means.

In embodiments the incline in the conveying means is between about 20 and about 80 degrees from horizontal, between about 30 and about 70 degrees from horizontal, between about 30 and about 60 degrees from horizontal or between about 40 and about 50 degrees from horizontal.

In one embodiment the apparatus further comprises a transverse trough in the prewash module. In some embodiments the trough is disposed adjacent the inside of the entrance of the apparatus. In some embodiments the trough is situated before the incline of the conveying means, and the conveying means moves the mat through the trough before it moves the mat up the incline.

In one embodiment the apparatus further comprises a collection tank to collect water used in the wash and/or rinse module. In some embodiments the collection tank is under the entrance of the housing.

In one embodiment the apparatus further comprises a settling tank to receive water from the collection tank. In one embodiment the settling tank is under the wash and/or rinse module.

In embodiments the extraction module comprises a plurality of air knives positioned to direct a stream of air onto the pile side of the mat. In some embodiments the incline in the conveying means extends to the extraction module, and the air knives direct the stream of air onto the pile side of the mat when the mat is on the incline.

In some embodiments the apparatus further comprises a means for holding the mat flat when the mat is moving along the incline of the conveying means.

In another aspect described herein is an apparatus for washing a mat having a pile side and a backing comprising:

a) a housing having opposing sidewalls, a front end wall, a rear end wall, an entrance in the front end wall for receiving the mat pile side up and an exit in the rear end wall;
b) a conveyor belt for moving the mat through the apparatus from the entrance to the exit, first through a prewash module, then through a wash and/or rinse module and then through an extraction module;
c) said conveyor belt having a first inclined portion in the wash and/or rinse module and a second inclined portion in the extraction module;
d) said prewash module comprising a transverse trough,
e) said wash and/or rinse module comprising a plurality of high pressure nozzles positioned to spray water onto the pile side of the mat when it is on the first inclined portion of the conveyor belt;
f) said extraction module comprising a plurality of air knives positioned to direct a stream of air onto the pile side of the mat when it is on the second inclined portion of the conveyor belt.

In embodiments the incline in the conveying means is an incline of between about 40 and about 50 degrees from horizontal. In some embodiments the inclined portion of the wash and/or rinse module and the inclined portion of the extraction module are continuous.

In some embodiments the trough is disposed adjacent the inside of the entrance of the apparatus.

In some embodiments the apparatus further comprises a means for holding the mat flat when the mat is moving along the incline of the conveying means.

In embodiments the apparatus may further comprise a mud tank under the entrance, which collects water used in the wash and/or rinse module. The apparatus may further comprise a settling tank under the wash and/or rinse module, which receives water from the mud tank.

In another aspect, described herein is a method for cleaning a mat having a pile on one side, whereby the mat is conveyed along a conveying path and successively exposed to a prewash operation, a wash and/or rinse operation and an extraction operation, characterized in that during the wash and/or rinse operation the mat is treated with high pressure nozzles which spray water onto an area of the mat, while the area is oriented pile side up, and while the area is inclined.

In one embodiment the method further comprises, before the wash and/or rinse operations, conveying the mat through a trough which soaks the mat.

In one embodiment the method further comprises, during the extraction operation, directing a stream of pressurized air from air knives onto the area of the mat that has been treated with the high pressure nozzles, to dislodge water from the area.

In one embodiment the method further comprises moving the water that is dislodged by the air knives to a second area of the mat that has been subsequently treated with the high pressure nozzles.

In one embodiment the method further comprises holding the mat to keep the area that is inclined flat.

In one embodiment the method further comprises collecting the water in a mud tank and transferring this water to a separation tank to produce clarified water.

In one embodiment the method further comprises reusing the clarified water.

DETAILED DESCRIPTION

The inventors have developed a mat cleaning apparatus and method that enables a user/operator to introduce the mat into the apparatus with the pile or nap side up, so that the user can perform a quality inspection to identify and treat areas of the mat that need special or extra cleaning before the mat enters the apparatus. The user can apply precleaning solution, remove stuck on debris, or perform whatever steps are necessary, to promote the cleaning of these problem areas, so that the mat which exits the apparatus is satisfactorily cleaned.

The apparatus has three basic components—a prewash module, a wash and/or rinse module and an extraction module. Other modules may be added, for example a water treatment module, a mat rolling module, or a conveyor module that returns the rolled mat to the user of the machine.

Disclosed herein is an apparatus and method for cleaning mats, in which the mat is introduced into the apparatus pile side up. Cleaning mats pile side up in a system that uses water can be troublesome because a considerable portion of the dirt loosened by the cleaning process is not washed away by the treatment water, but rather settles back into the pile by gravity. The inventors have overcome this problem by placing the mat at an angle in the wash and/or rinse module of the machine. Dirt that is loosened by the water from high pressure nozzles is transported down the mat along with the water that is applied to the mat. Further, as the mat progresses up the incline this dirt is moved progressively down the mat by high shear forces from the high pressure water. Thus, the mat is supported pile side up within the apparatus on an incline, so that rather than settle down into the pile, the loosened dirt travels downwards along the mat with the wash or rinse water. This water and associated dirt exit the apparatus as a suspension, at the bottom of the incline. The suspension may at that point be disposed of, however preferably it is collected in a collection tank for further processing and reuse of the water therein, as described below.

High pressure nozzles are situated within the apparatus so that the water from these nozzles is applied to the mat on the incline, and will therefore flow downwards to regions of the mat that have not yet reached the nozzles. This water will pre-wet or pre-soak these regions before they are treated by the high pressure nozzles. Further, this water will carry some of the dirt in these regions down the incline so that it never reaches the nozzles, serving a prewash function.

In a preferred embodiment, the water that travels downwards along the mat incline is collected in a trough disposed at the bottom of the incline. This trough holds a volume of water to effectively pre-soak the mat before it begins to travel up the incline. While a region of the mat is in the trough, some of the dirt in this region may be loosened by the water. As this region travels up the incline, water travelling down the incline may move at least some of this dirt down the incline so that it never reaches the height of the nozzles. This effectively pre-cleans this region of the mat before it is subjected to the spray from the high pressure nozzles. Water and associated dirt flow out of the trough as a suspension, and may at that point be disposed of. However, preferably this suspension is collected in a collection tank for further processing and reuse of the water.

If a collection tank is used, in preferred embodiments this tank is a mud tank, and this tank is preferably mobile (wheeled). The suspension that is collected in the mud tank may be further processed, in a settling tank, to remove suspended dirt particles from the water. The settling tank may comprise a series of compartments separated by weirs. Water and suspended solids enter the settling tank, and in the tank suspended solids settle as sludge at the bottom, while clarified water moves over the series of weirs to the outlet where it is removed. The clarified water may then be reused in the apparatus and method, or discarded. The bottom of the settling tank may be slightly sloped, to promote sludge accumulation on one side of the tank, from where it is collected.

Other embodiments contemplate using a means hold the mat flat while it is being transported along the incline. Because the mat is on an incline in the wash and/or rinse module, mats that are not sufficiently rigid can slide down the incline and bunch up, leading to jamming of the machine and/or incomplete cleaning. The inventors have therefore devised a means to support the mat while it is on the incline using, for example a rod and/or string assembly, as described further below.

As used herein, the term "mat" refers to any flat object comprising a pile or nap side and a backing. The backing may comprise rubber or vinyl or other materials, for example non-slip materials. Examples of mats as contemplated herein include industrial floor mats, rugs, or other flat objects, automobile mats, and residential area rugs and mats. Also, as used herein, the term "dirt" refers to any debris present on or in the mat, including but not limited to dust, dirt, gum, or any other foreign matter.

Having thus described the basic apparatus and method herein, specific embodiments will now be described, having reference to the accompanying Figures.

Figure 2:
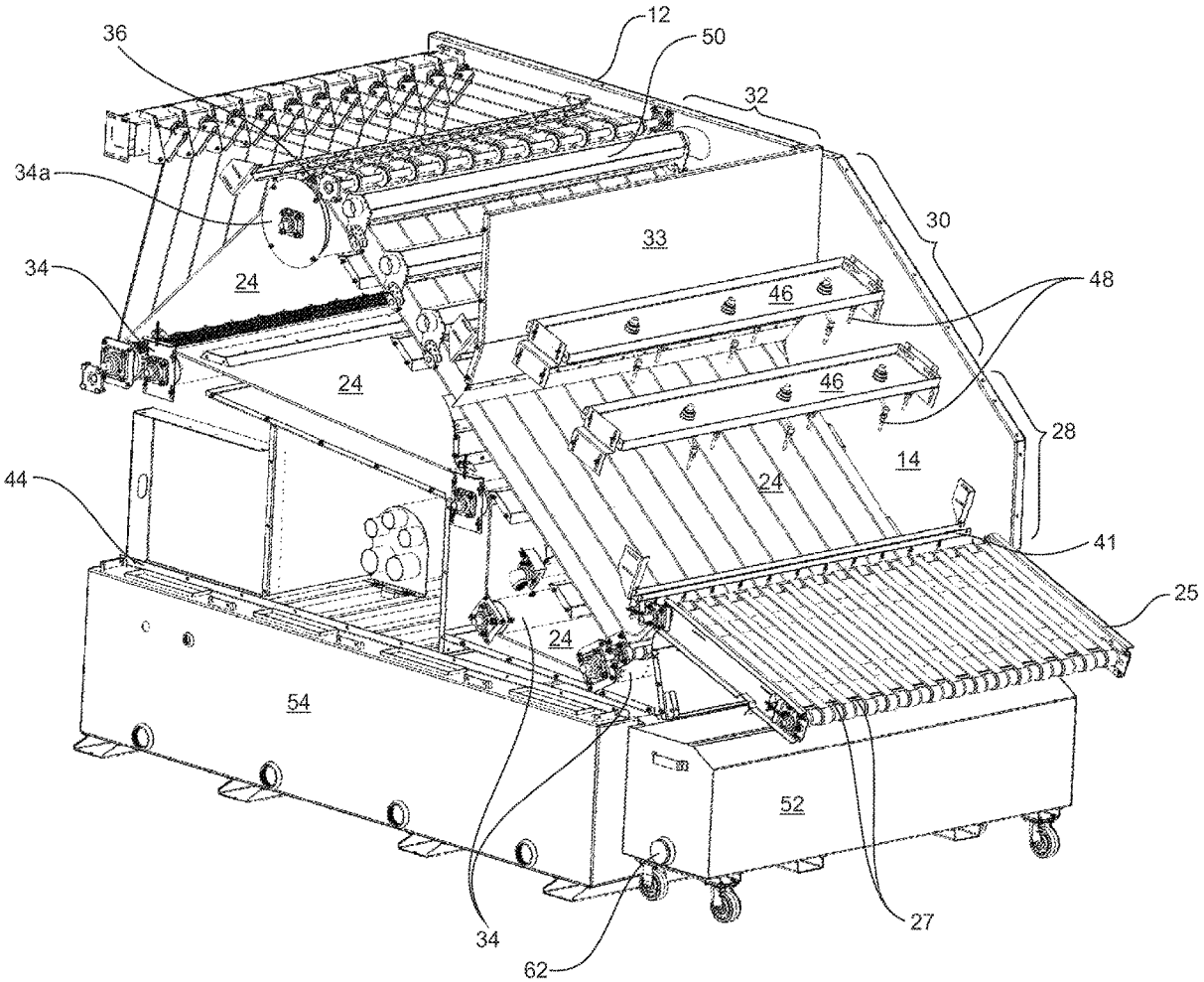
FIG. 2 is a side perspective view of the embodiment of FIG. 1 with the right sidewalls removed.
Figure 3:
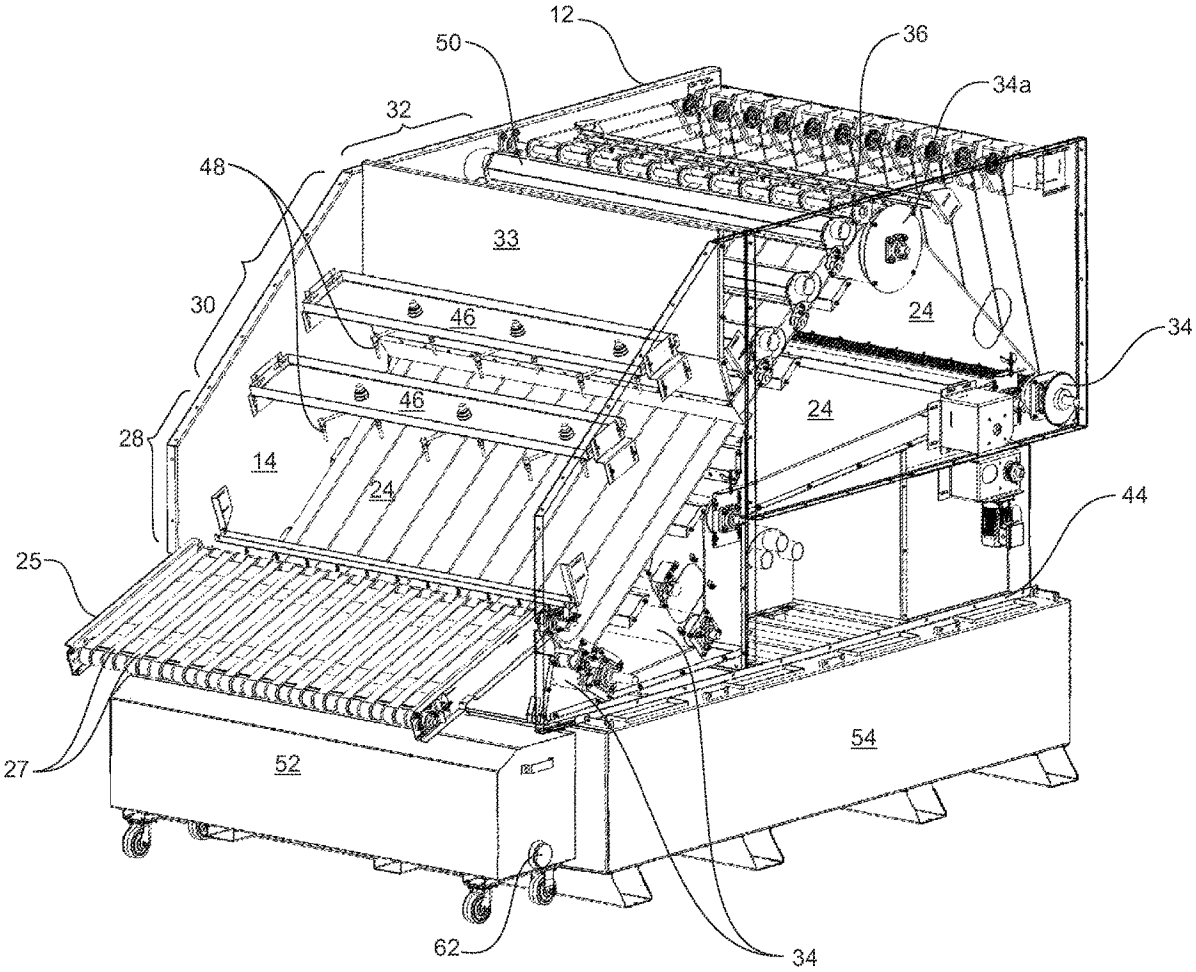
FIG. 3 is a side perspective view of the embodiment of FIG. 1 with the left sidewalls removed.
Figure 5:
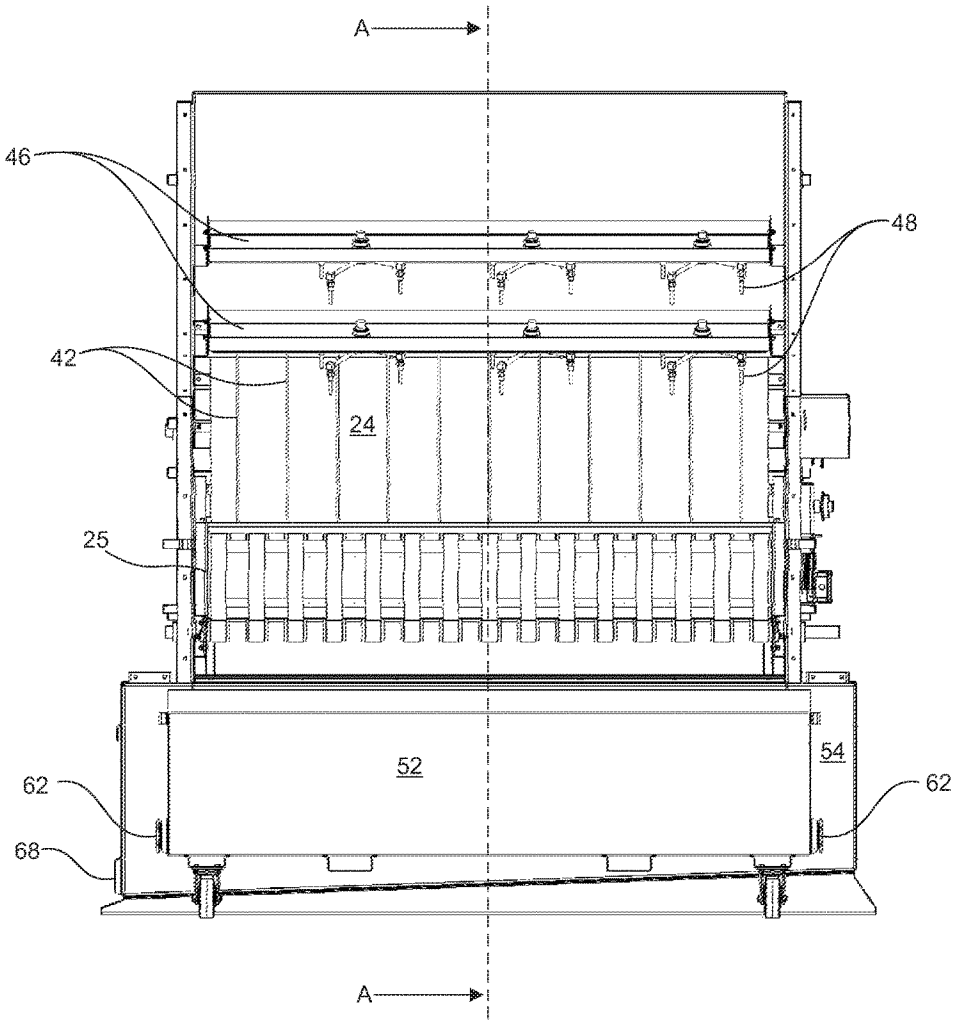
FIG. 5 is an end view of the embodiment of FIG. 1, looking at the mat entrance.
Figure 6:
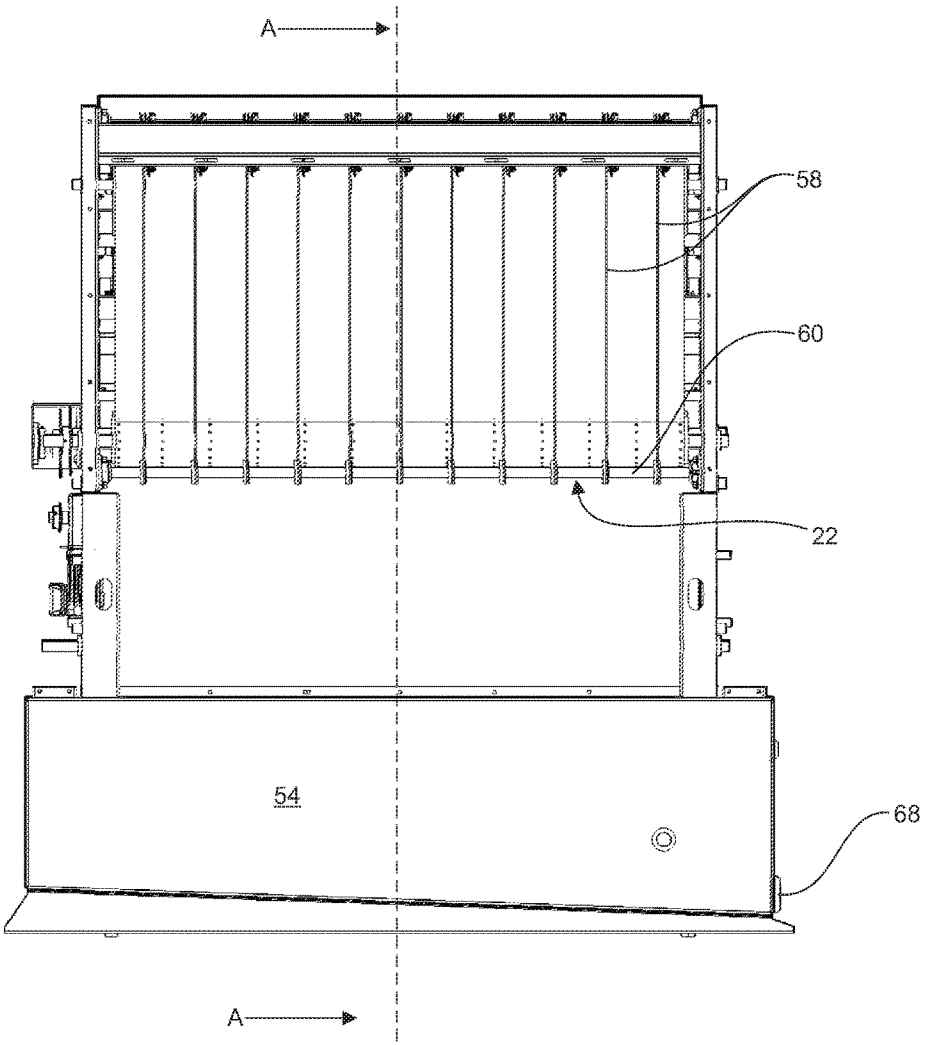
FIG. 6 is an end view of the embodiment of FIG. 1, looking at the mat exit.

FIGS. 1 to 3 are side perspective views of an embodiment of the mat cleaning and drying apparatus. The mat cleaning and drying apparatus 10 comprises a housing 12 having spaced side walls 14, 14 a front end wall 15 (FIG. 5) and rear end wall 16 (FIG. 6). The housing interior 18 defines three sections or modules between an entrance 20 and an exit 22 of the housing, beginning with a prewash module 28, followed by a wash and/or rinse module 30 and then an extraction module 32. A mat conveying means 24, preferably a conveyor belt or series of conveyor belts, is mounted to the housing 12 and extends at least between the entrance 20 and the exit 22 of the housing. In this embodiment a partition element 33 separates the wash and/or rinse module 30 from the extraction and/or drying module 32.

A mat 26 to be cleaned is placed on the mat conveying means 24 with the nap/pile side facing up, and is conveyed through the various sections of the housing 12 by the conveying means 24. If the mat conveying means is a conveyor belt, this belt may have different configurations, such as in some embodiments or sections the external surface of the belt may have ribs running across its width, and in some embodiments or sections the external surface of the belt may be smooth. The belt may be solid or may have openings through which water can pass. Further, the width of the conveyor belt may also differ from section to section or between embodiments. For example, in one embodiment, the belt may be 2 inches wide in some sections and 8 inches wide in other sections. The conveying means may two or more conveyor belts operating in series. The above stated configurations and widths are exemplary and contemplated herein are other belt configurations and widths.

Figure 9:
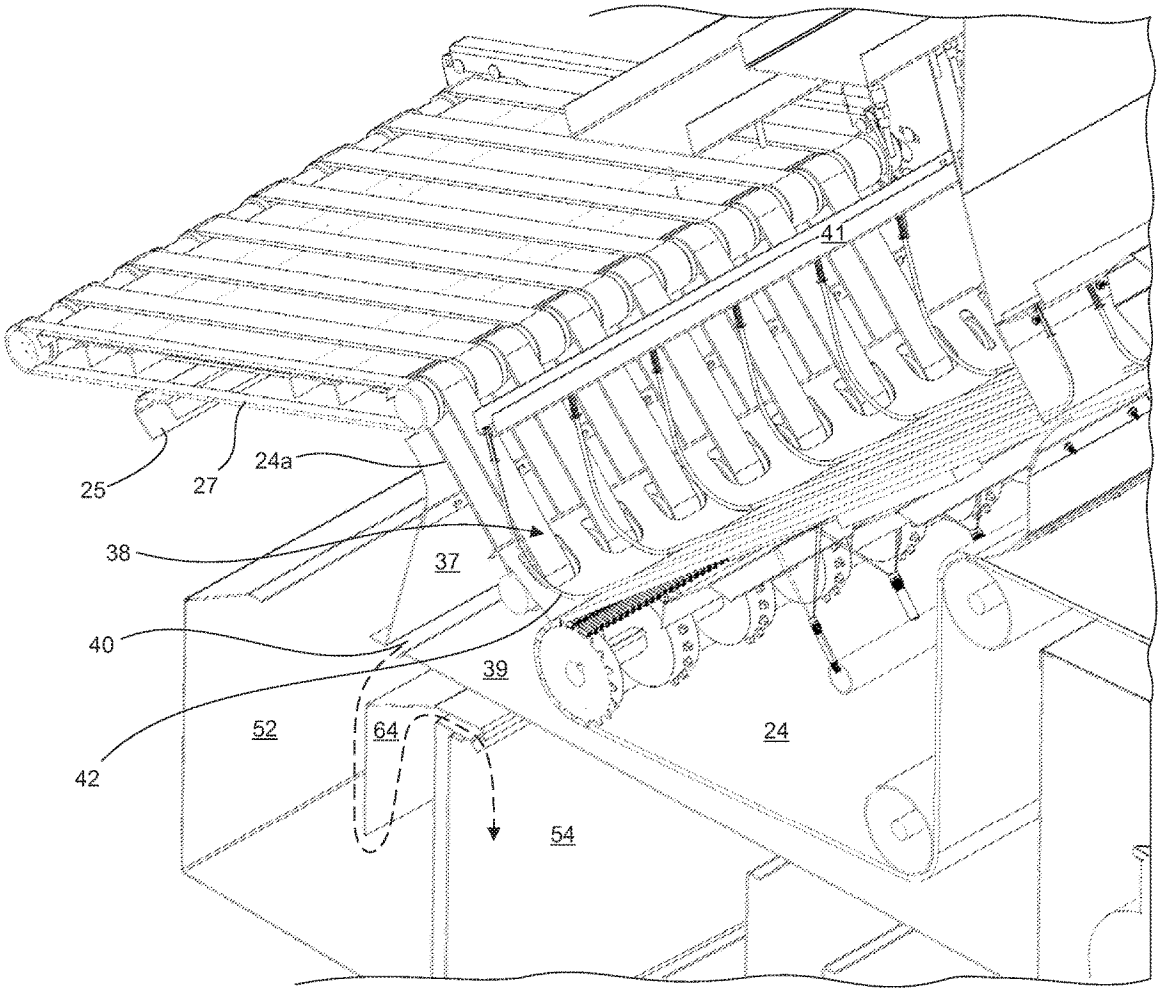
FIG. 9 is a close up view of the mat entrance (front end) of the drawing in FIG. 8.

In the embodiment shown in FIG. 1, the conveying means 24 is a primary conveyor belt, the structure of which can be seen more clearly in FIGS. 2 and 3, coupled with a secondary conveyor belt (24*a*) extending inwards from entrance 20 (see FIG. 9). The conveyor belt is guided by a number of transverse rollers 34 which extend between the sidewalls of the housing, and which are driven by a drive roller 34*a*. The conveyor belt is moved continuously in a circular fashion within the interior 18 of the housing 12, passing by both the entrance and the exit ends of the apparatus.

In this embodiment conveying means 24 further has a peak 36 at about the position of the driver roller 34*a*, thus the conveying means is inclined generally upwards relative to the entrance 20 of the apparatus. Thus, after the mat 26 enters the apparatus at the entrance 20, it proceeds upwards through the prewash module 28 and upwards to the wash and/or rinse module 30.

However in other embodiments the conveying means may be inclined downwards from entrance 20, or the conveying means may have two or more peaks and therefore two or more inclined sections. An "inclined" conveying means, as used herein, refers to a conveying means that has a sufficient slope or gradient so that loosened dirt, rather than settling down into the pile of a mat when wash and/or rinse water is applied to it, tends to travel downwards along the mat with the water.

Nap side up positioning allows an operator/user to inspect and pre-treat the mat 26 before it proceeds to the interior 18 of the housing. Inspection may include an examination of the mat for stains, presence of foreign matter such as chewing gum or any other quality-related issues. To facilitate examination of the mat and insertion of the mat into the entrance of the apparatus and onto the conveying means 24, embodiments contemplate a delivery platform 25 disposed at the entrance 20 of the apparatus. The delivery platform provides a planar and generally horizontal surface over which mat 26 can be spread to facilitate examination and pretreatment. Delivery platform 25 may further comprise a conveying means 27, such as a conveyor belt, to facilitate movement of the mat 26 towards entrance 20 and insertion of the mat into the apparatus.

Figure 4:
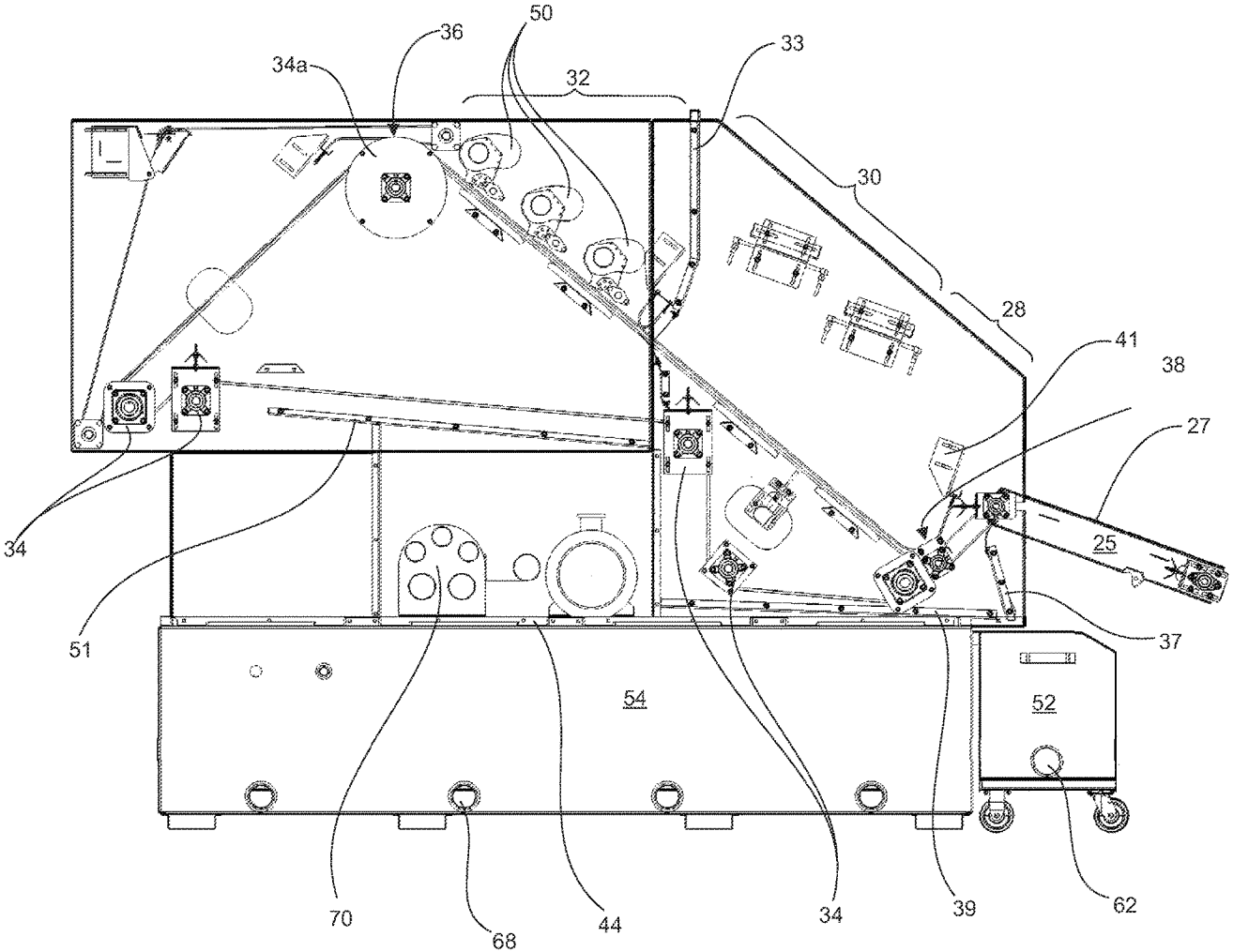
FIG. 4 is a plan view of the right side of the embodiment of FIG. 1, with the right sidewalls removed.

After completion of the inspection, mat 26 enters apparatus 10 and proceeds first through the prewash module 28. This module wets or soaks mat 26 to loosen dirt present therein or thereon. As shown in FIGS. 2-4, in the prewash module the conveying means 24 may have the same angle of incline as it does in the wash and/or rinse module 30. Contemplated herein, however, are conveying means in which the angle of incline is different, as between the prewash module 28 and the wash and/or rinse module 30.

As can be seen in the embodiments shown in FIGS. 2-4 the prewash module is on the same incline but below the wash and/or rinse module. Thus, water from the wash and/or rinse module will flow downwards to wet or soak regions of the mat before these regions are actually treated by the nozzles in the wash and/or rinse module. This wetting or soaking of the mat functions to loosen dirt or pre-soak stains, so that the mat is more thoroughly cleaned at the wash stage.

Further, at least some of the dirt on the mat may be transported down the inclined mat away from the high pressure nozzles above. In embodiments where the incline proceeds downwards towards the entrance 20 of the apparatus, the bottom of the incline comprises a means to prevent the water and suspended dirt particles from exiting the apparatus through entrance 20. For example, an extended flat area at the bottom of the incline optionally coupled with a vertical plate that prevents water from exiting at the entrance end may be used to prevent water from flowing out of entrance 20.

However, embodiments preferably include, as a component of the prewash module, a trough 38 disposed at the bottom of the incline. Trough 38 extends substantially between the sidewalls 14,14, and it functions to consolidate the water that flows down the incline from the wash and/or rinse module and to direct it out of the apparatus, preferably into a collection tank. In cross section trough 38 preferably has a "U" or "V" shape, and water exits the trough via one or more openings in the trough.

Figure 8:
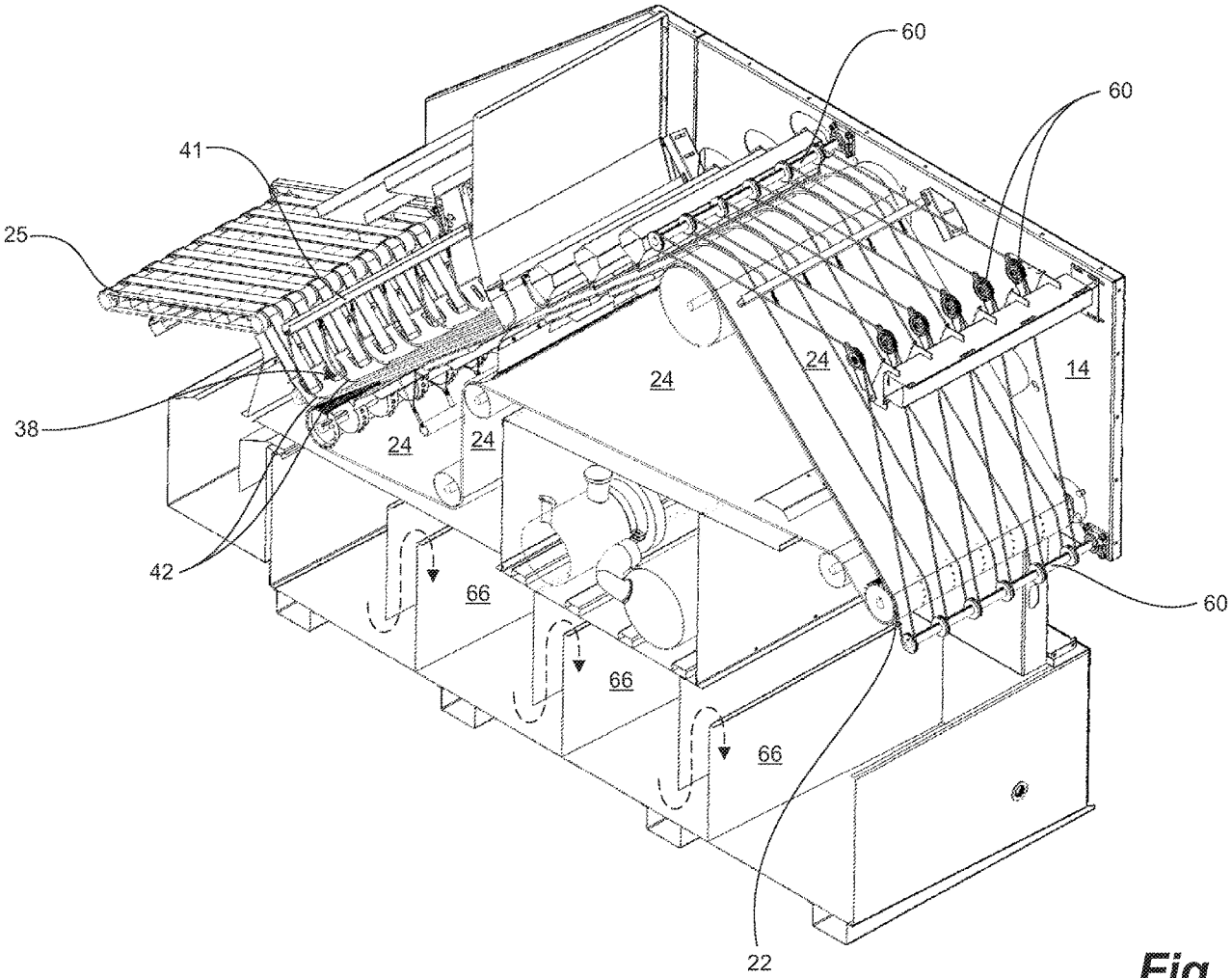
FIG. 8 is a side perspective view of a cross section through the embodiment of FIG. 6, along line A-A.

An embodiment of the trough is exemplified in FIGS. 8-9. In this embodiment trough 38 is immediately inside entrance 20 and is formed by conveying means 24, more particularly on one side by conveyor belt 24*a* and on the other side by conveyor belt 24. Plate 37, which is approximately vertical, is disposed inside entrance 20 and under conveying means 24*a*, and plate 39 which is approximately horizontal, is disposed underneath conveyor belt 24. These two plates form an opening 40, through which water can flow.

As the leading edge of a mat 26 proceeds into the entrance 20, it either falls or is pushed downwards (by the operator/user) under a transverse bar 41, to which is attached the ends of guide rods 42. The guide rods 42 force the mat downwards to the bottom of the trough 38, after which the leading edge of the mat is directed upwards along the conveyor belt, between the conveyor belt and rods 42. A trough therefore is formed in the mat when it is inserted into this part of the apparatus.

Water from the wash and/or rinse module that flows downwards along the inclined mat will therefore pool on the portions of the mat that are in trough 38, where it thoroughly soaks the mat. Water (with suspended dirt) flows over the side edges of, or through, the mat and falls between plates 37 and 39, where it will then be directed through opening 40, and preferably into collection tank 52. As can be seen more clearly in FIG. 4, plate 39 is downwardly sloped towards opening 40, so that water will flow along the plate and into opening 40. It is to be noted that in this embodiment of the apparatus plate 39 extends underneath the prewash module and under the wash and/or rinse module, in order to collect and direct water from these modules through opening 40 and into the collection tank.

In other embodiments trough 38 may be formed, for example, from a metal sheet that is bent into a "U" or "V" shape in cross section, and which has one or more openings along its bottom for water to flow through.

Figure 7:
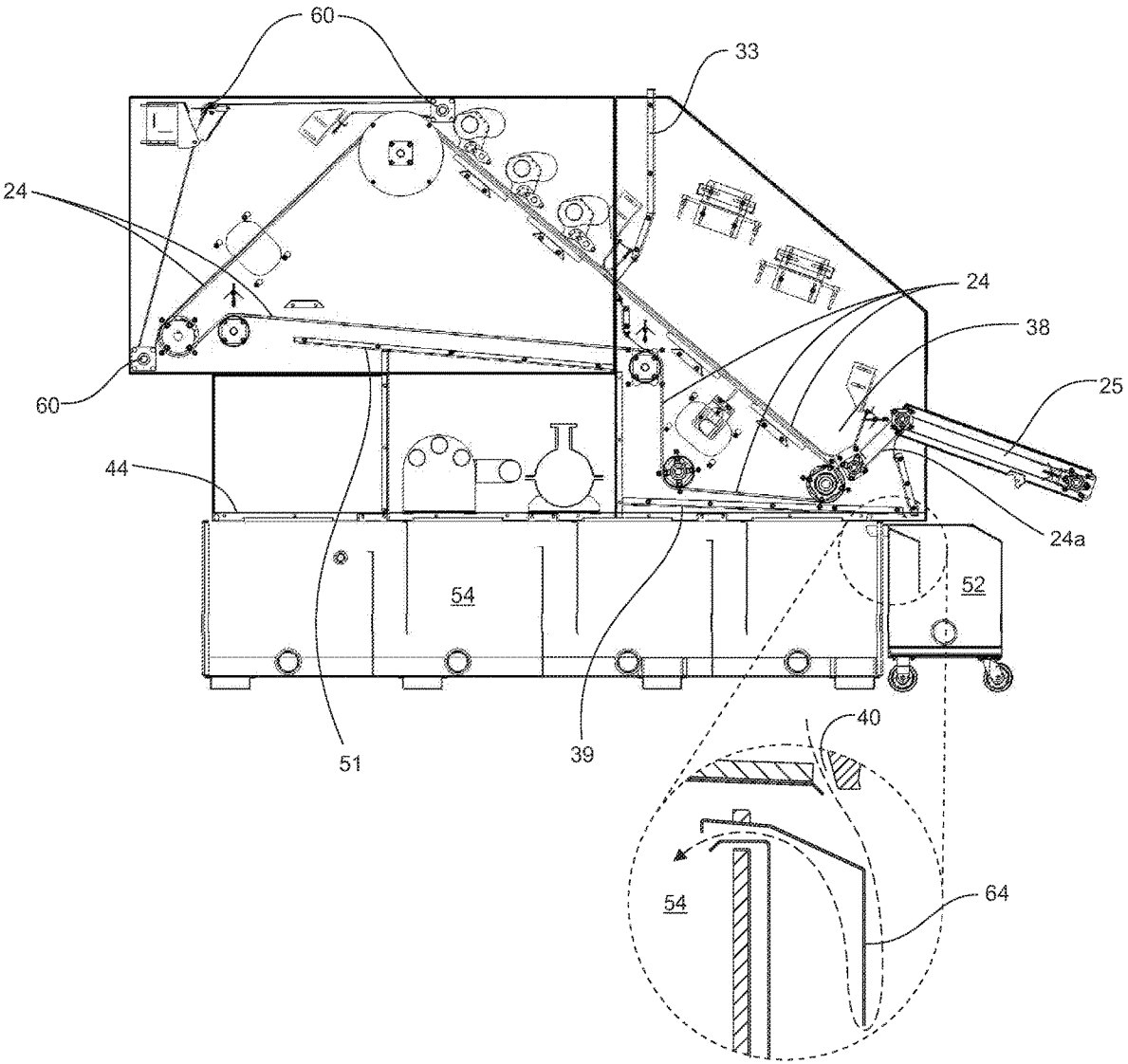
FIG. 7 is a cross section view through the embodiment of FIG. 5 along line A-A.

After exiting the prewash module 28, the wetted mat proceeds to the wash and/or rinse module 30, in which mats are exposed to high pressure water to dislodge dirt that is on and within the pile. In this module, and as seen in FIGS. 4 and 7, the conveyor belt 24 has an axis that is inclined relative to the housing floor 44, so as to form an acute angle with the housing floor (which in this embodiment is horizontal). In the embodiment shown, the axis of the conveyor belt defines about a 45 degree angle with the axis of the housing floor.

This disclosure also contemplates an angle between the axis of the conveying means and the horizontal axis that is greater or lesser than about 45. Further, this disclosure contemplates the use of different angles in different parts of the wash and/or rinse module 30. The angle is selected so that the corresponding mat incline is sufficient to promote the movement of loosened dirt downwards along the mat with the water from the wash and/or rinse module. The steeper the angle the more effective gravity is, in moving dirt down the mat. However, this has to be balanced with the difficulties encountered in moving a mat up a steep incline. Embodiments therefore contemplate an angle between the axis of the conveyance means and the horizontal axis, within the wash and/or rinse module, of between about 20 and about 80 degrees, preferably between about 30 and about 70 degrees, more preferably between about 30 and about 60, and most preferably between about 40 and about 50 degrees.

The wash and/or rinse module 30 comprises a plurality of liquid spray nozzles 48 which spray water at a high pressure on to the mat. "High pressure" as used herein means a water pressure that maximizes the cleaning action of the water and minimizes damage to the mat itself. It has been found that generally a pressure of greater than about 500 psi, more preferably greater than about 700 psi, is effective. In preferred embodiments, such as that exemplified in the Figs. herein, the pressure used is about 1,000 psi. "Water" means a water solution that may include a detergent, an antimicrobial agent (to kill mold or fungus) for removing unwanted odours, or other chemicals, or it may be clean water, or water that is recycled from the apparatus.

The nozzles 48 preferably spray water onto the mat at an angle that is slightly less than perpendicular (i.e., about 87 degrees) to the surface of the mat. This angle optimizes both cleaning force on the mat (the ability to dislodge dirt down to the bottom of the pile) and movement of dirt down the mat incline in the direction of the water spray. Thus, the angle between the axis of the spray from the nozzles and the surface of the mat is preferably between about 70 to about 90 degrees, more preferably between about 80 to about 90 degrees and most preferably between about 85 and about 90 degrees. In yet other embodiments the angle of the nozzles may be varied within any one cleaning cycle.

Figure 10:
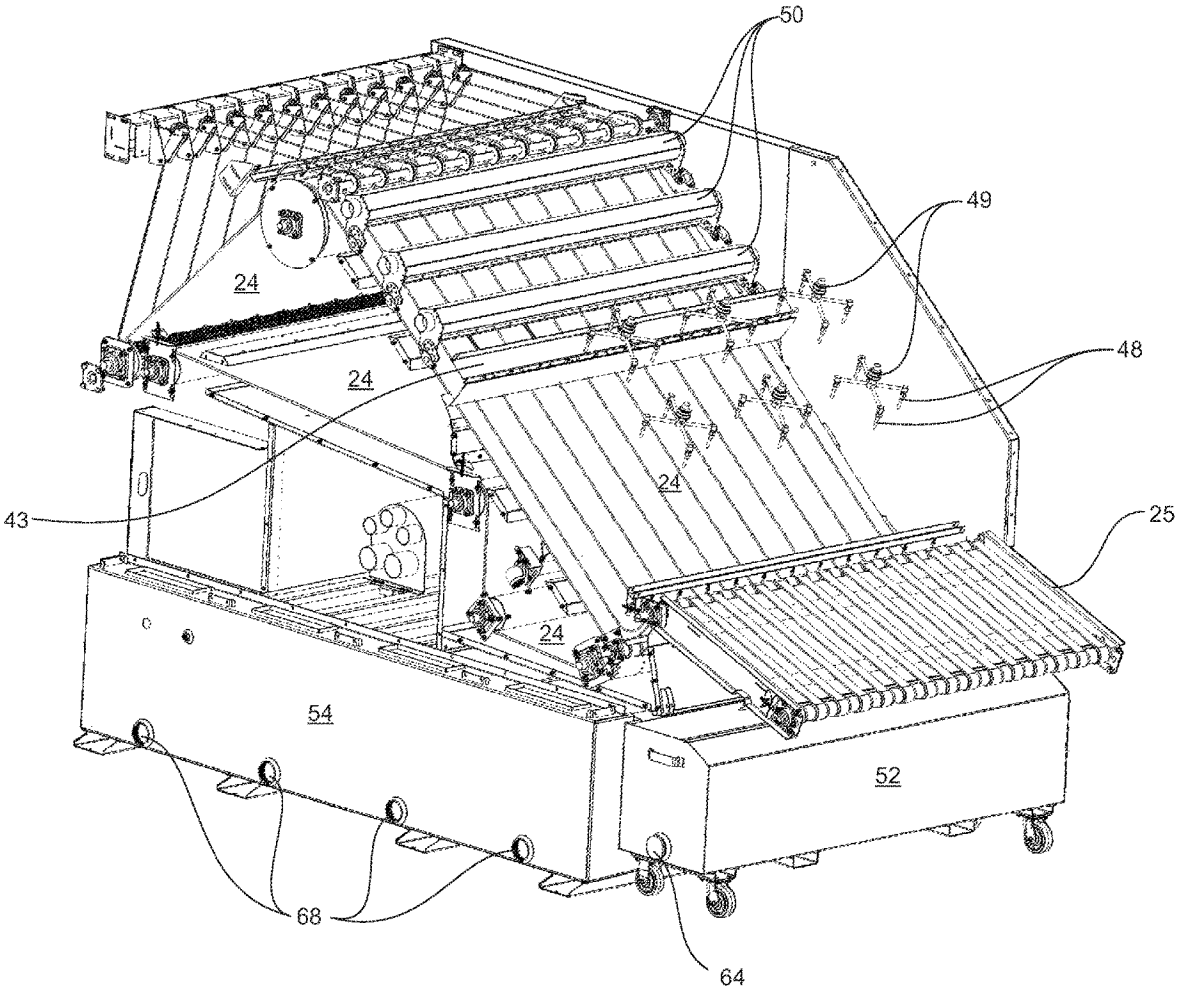
FIG. 10 is a side perspective view of the embodiment of FIG. 1 with the right sidewalls removed, the nozzle transverse headers removed, and the partition element removed, to show the nozzle assembly and the knife assembly.

In one embodiment of the wash and/or rinse module, and as seen in FIGS. 1-3 and 5, one or more transverse header blocks 46 extend between the side walls 14, 14 of the housing 12. A plurality of liquid spray nozzles 48 are mounted on the header block 46. FIG. 10 illustrates this embodiment of the nozzle arrangement, with the transverse header blocks and brackets removed from the drawing seen in FIG. 2. As seen in FIG. 10, this embodiment of the nozzle assembly comprises a plurality of nozzles 48 coupled to a rotator 50 for rotating the nozzle assembly. In the exemplary embodiment illustrated in FIG. 10, the nozzle arrangement comprises six rotators 50 and each rotator has four nozzles 48 coupled thereto. When the nozzles are rotated, water streams being sprayed from the nozzles impinge all the portions of the mat, thereby eliminating dry spots. Thus, the mat is essentially washed several times as it travels through the wash and/or rinse module 30. In this embodiment the angle between the axis of the spray from the nozzles and the surface of the mat is about 87 degrees.

In alternative embodiments, nozzles 48 may be arranged in a row, laterally spaced from each other along the row, and the wash and/or rinse module may comprise a plurality of rows of nozzles. This arrangement of nozzles delivers spray water evenly onto the mat 26 passing through the wash and/or rinse module 30 including sides of the mat adjacent to the side walls 14, 14 of the housing.

It is to be understood that the nozzle arrangement may be configured such that one set of nozzles ejects a different solution from another set, for example, one set of nozzles ejects a cleaning fluid spray (e.g., water with a chemical cleaning agent) and another set of nozzles ejects a clean water spray. One header may therefore be connected to a reservoir of cleaning fluid and another to a reservoir of clean water by means of one or more supply ducts. In the embodiment shown in the Figs. herein, all nozzles are the same and eject the same solution, which is preferably recycled water from the separation tank 54 optionally containing a water conditioner for odour control and to kill mold or fungus. However, other embodiments contemplate distinctions between the nozzles or the solutions that they spray. For example, a series of nozzles may wash the mat with a detergent followed by a series of nozzles that rinse the mat with clean water.

In embodiments, the wash and/or rinse module may be subdivided into two or more sub-modules and the mat 26 may be subjected to different washing and/or rinsing actions in each of the sub-modules. For example, there may be a first sub-module in which the mat is washed, and a second sub-module in which the mat is rinsed. The mat may be inclined only in the wash sub-module, only in the rinse sub-module or in both the wash and/or rinse sub-module. The angle of incline may be different between the sub-modules.

Water used by the wash and/or rinse module may be reused and recycled. The water may be collected in any suitable manner and may be cleaned prior to reuse. In one embodiment the water is collected in a collection tank 52 after which it may be discarded or recycled for further use.

After passing through the wash and/or rinse module 30 the mat 26 enters the extraction module 34. Extraction module 34 removes residual water from the mat and can remove almost all or only some of the water, resulting in a dry or damp mat, as desired. In embodiments, the extraction module may be subdivided into two or more sub-modules and the mat 26 may be subjected to different extraction and drying actions in each of the sub-modules. For example, there may be a first sub-module which extracts water with a vacuum or air knife assembly, and a second sub-module which dries the mat using heat.

In the embodiments shown in the Figures herein, conveying means 24, and consequently the mat, is inclined while in the extraction module 34, and the angle of incline is the same as in the wash and/or rinse module 30. However this is not necessary. The mat may have a different incline from that in the wash and/or rinse module, and may even be horizontal in the extraction module. The advantage of the embodiment shown in the Figures herein, which has a continuous incline between these two modules is that the water which is moved or forced out of the mat by the air knives 50 is disposed further down the incline onto wetter regions of the mat and eventually off the trailing edge of the mat.

In one embodiment of the extraction module 34, and as seen in FIGS. 1-3 and 10, one or more air knives 50 extend between the side walls 14, 14 of the housing 12. FIG. 10 illustrates this embodiment of the air knife assembly, with the partition element 33 removed from the drawing seen in FIG. 2. As seen in FIG. 10, the air knife assembly comprises a plurality of air knives 50 which extend the width of the machine and which sequentially remove residual water from the mat. Air may be supplied to the air knives through one or more blowers 70, which may be connected to the air knives 50 with piping.

The air knives direct a stream of pressurized air onto the mat at an angle that is slightly less than perpendicular (i.e., about 87 degrees) to the surface of the mat. This angle optimizes both the force on the base of the pile (to remove water down to the bottom of the pile), and the movement of water down the mat incline. Thus, the angle between the axis of the stream of pressurized air from the air knives and the surface of the mat is preferably between about 70 to about 90 degrees, more preferably between about 80 to about 90 degrees and most preferably between about 85 and about 90 degrees. Residual moisture contained in the mat can thus be removed.

It is to be noted that in this embodiment, and as best seen in FIGS. 4 and 7, a plate 51 is disposed underneath the air knives. This plate 51 is inclined downwards towards plate 39, and captures water that is removed from the mat by the air knives, which then flows onto plate 39 and through opening 40 and into the collection tank.

The extraction module 34 may further comprise a vacuum block (not shown) having an array of vacuum heads which vacuum or extract moisture contained in the mat 26. The vacuum block may be situated before or after the air knife assembly.

After being dried, mat 26 proceeds along conveying means to exit 22 for discharge from the apparatus 10. In one embodiment, the apparatus 10 may be further equipped with an automatic roller (not shown) at exit 22. The automatic roller rolls the mat upon itself before the mat 26 is unloaded from the conveyor belt 24.

Figure 11:
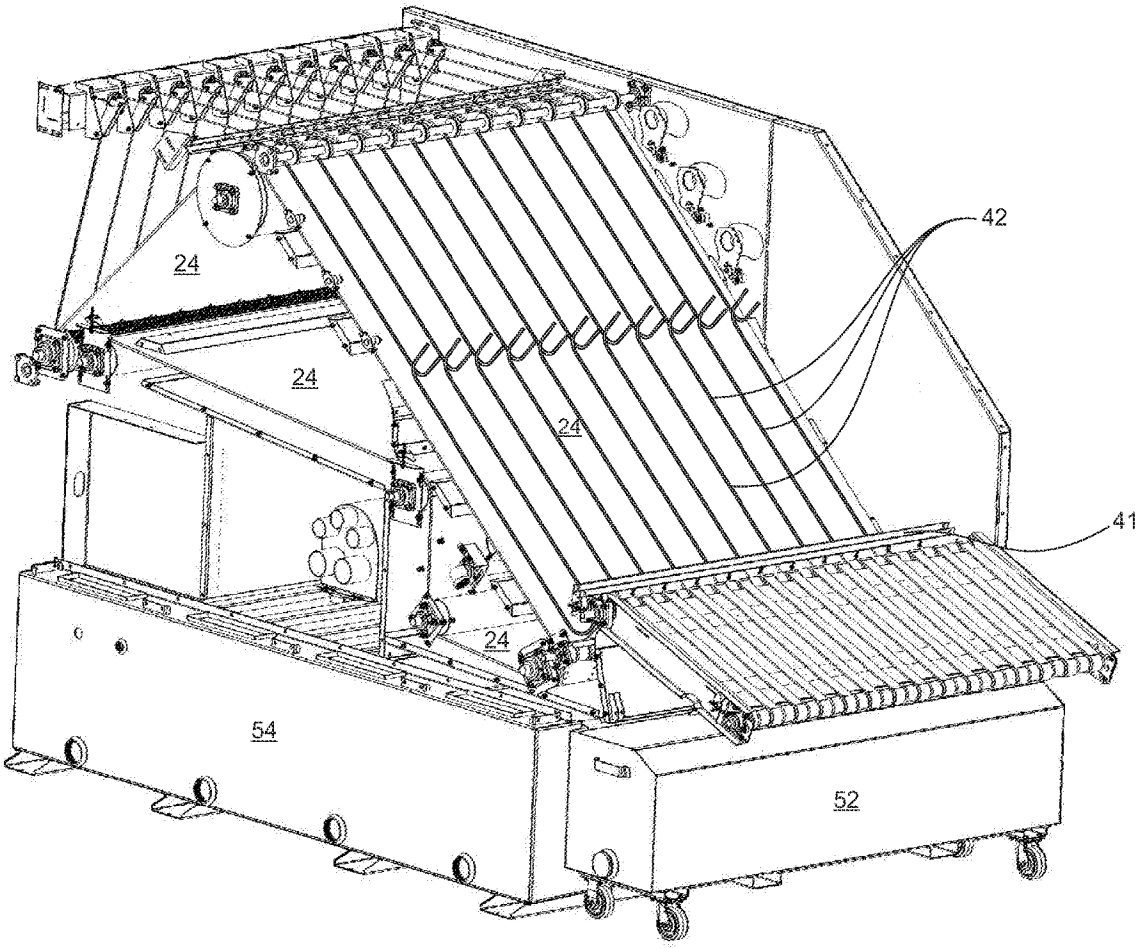
FIG. 11 is a side perspective view of the embodiment of FIG. 1 with the right sidewalls removed, the nozzle transverse header removed, the air knives removed and the partition element removed, to show the guide rod assembly.

FIG. 11 shows one embodiment of a means that can be used to ensure that a mat remains flat while it is being transported up along the incline, as a mat that folds will not be cleaned properly and may jam the apparatus. In this embodiment, guide rods 42 extend from transverse bar 41 (see FIG. 9) up to and over peak 36 (see FIG. 13). In the embodiment shown in FIG. 11 the guide rods are each made of two parts connected at about the middle of the incline by attachment to a transverse bar 43 (see FIG. 10). The guide rods are spaced from the conveyor belt so that a mat can fit between the rods and the conveyor belt. Other means can be used to ensure that a mat remains flat on the incline, such as for example an assembly of strings that moves with the mat (see next), or a combination of strings and guide rods, or a clamp that grasps the leading edge of the mat.

Figure 12:
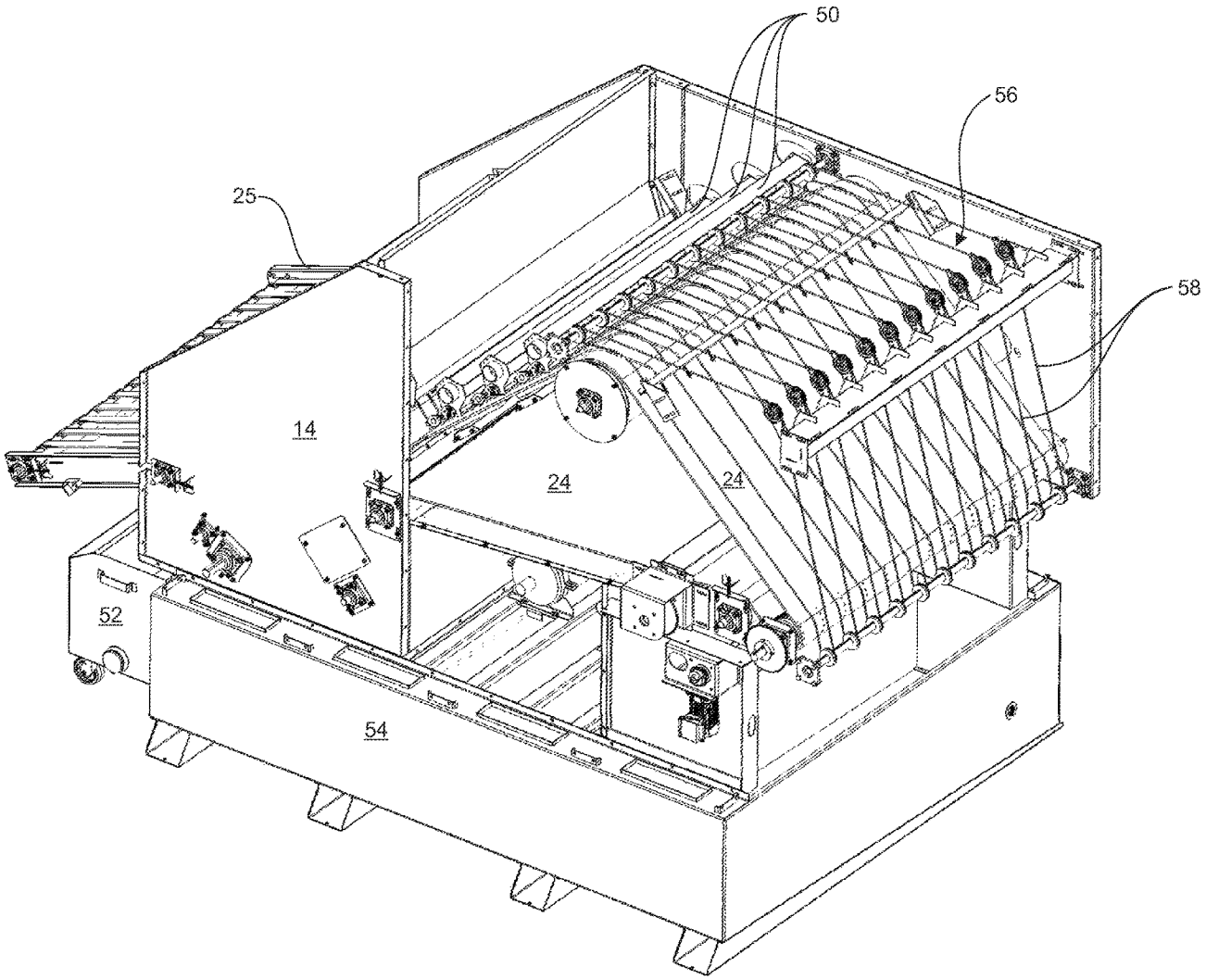
FIG. 12 is a rear perspective view of the embodiment of FIG. 1 with part of the right sidewall removed.
Figure 13:
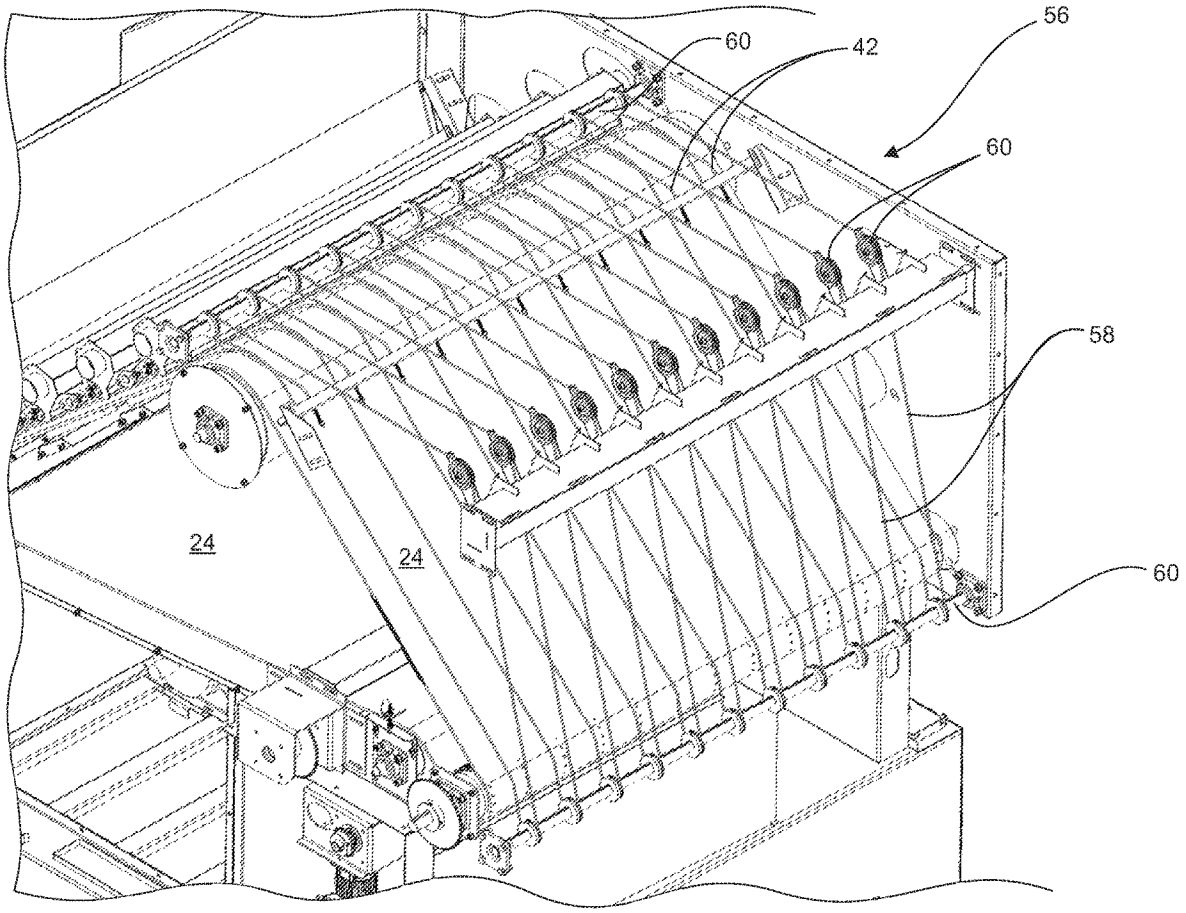
FIG. 13 is a close up of the mat exit (rear end) of the drawing in FIG. 12, showing the string assembly.

After the leading edge of the mat has moved over peak 36, and while it is moving down the decline on the other side of this peak, it is advantageous to hold the mat onto the conveyor belt to ensure that it is properly delivered out of exit 22. To this end, and as shown in FIGS. 12 and 13, a string assembly 56 may be used. The string assembly 56 comprises a series of strings 58 assembled on transverse rollers 60 which are moved continuously in a circular fashion within the interior 18 of the housing 12, passing by both the peak 36 and the exit 22 of the apparatus. The leading edge of a mat passes over the peak and under the strings 56, which are spaced from the conveyor belt, so that the mat can fit between the strings and the conveyor belt. It is advantageous that the strings move with the mat, as this avoids bunching up or crumpling of the mat. The string assembly may be powered by a drive roller, however in the embodiments shown in the Figs. herein, its motive force comes from the mat itself.

Figure 14:
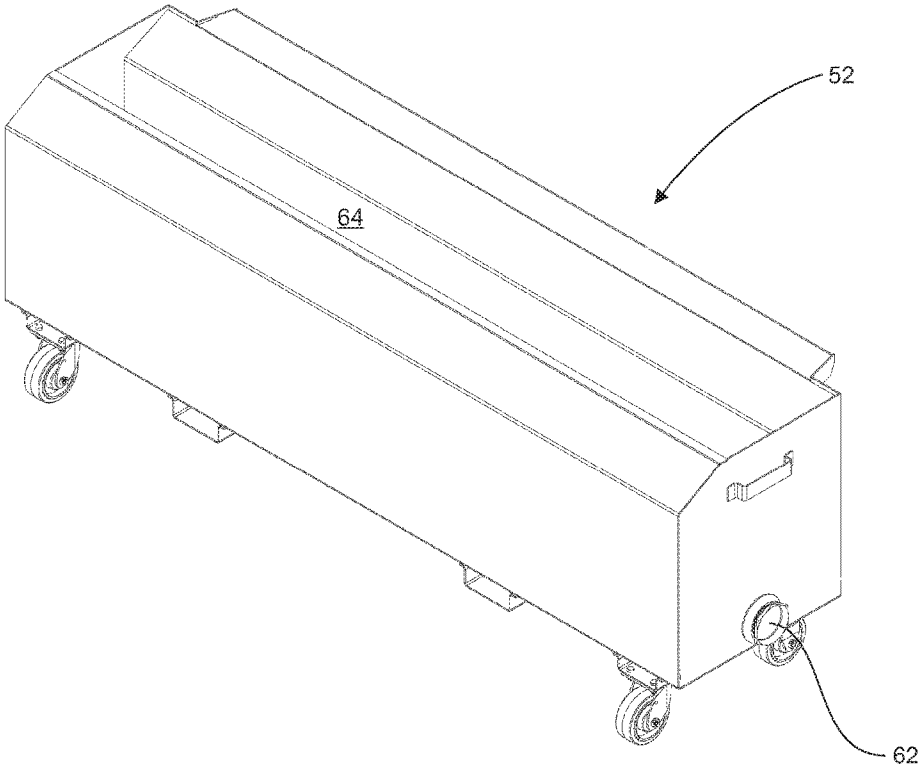
FIG. 14 is a perspective view of an embodiment of the mud tank.
Figure 15:
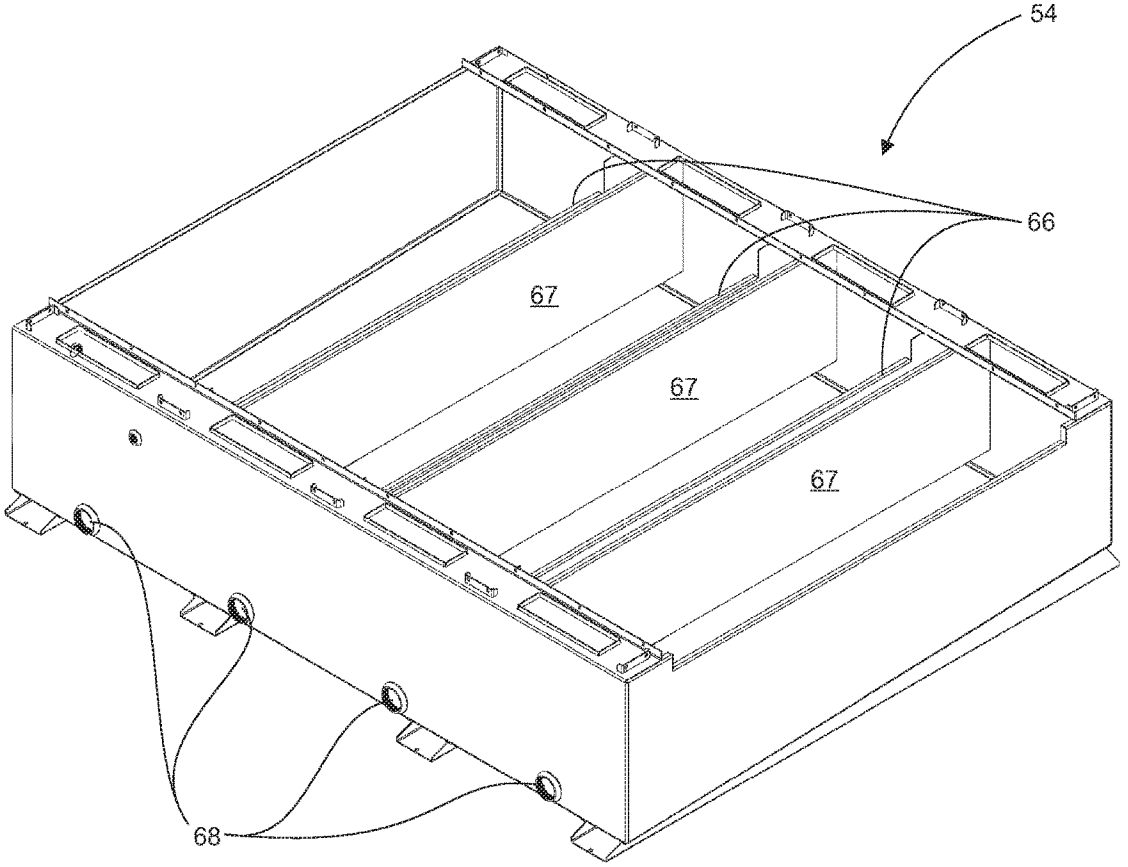
FIG. 15 is a perspective view of an embodiment of the settling tank.

Embodiments of the apparatus may further comprise a collection tank 52 for collecting water and suspended dirt that flows out of the apparatus at the bottom of the incline. The collection tank 52 may be integral to the apparatus or, in preferred embodiments is a separate mobile (wheeled) unit that can be removed from the apparatus. Collection tank may include one or more outlets 62 which facilitate emptying of the tank (FIG. 14).

The apparatus may further comprise a water treatment module which cleans the water that is collected from the apparatus so that it can be reused. In preferred embodiments the water treatment module performs a solid-liquid separation, separating the suspension of water and dirt particulates into a clarified supernatant which is reused, and a concentrated sludge which is discarded. To this end, the water treatment module may comprise a mud tank and a settling tank.

An embodiment of the water treatment module is shown in FIGS. 1-5, 8, 9, 14 and 15. In this embodiment, collection tank 52 is a mud tank. The apparatus 10 essentially rests on top of settling tank 54, which has about the same footprint as the apparatus. Water flows from the mud tank into the settling tank, as shown by the dashed arrow in FIG. 7 (inset) or FIG. 9. Plate 64 in the mud tank functions as a primary separator, to enhance the separation large dirt particles out of the water so that they do not enter the settling tank.

The water and suspended dirt that is directed into the settling tank 54 is further processed through a series of compartments that are formed by a series of baffles 67 and weirs 66. Suspended solids present in the water, which have a specific gravity greater than that of water will settle down by gravity and be trapped by the baffles and weirs, whereas clarified water will pass under and over the series of baffles and weirs (see dashed arrows in FIG. 8) to an outlet where it is removed and may be reused in the apparatus or discarded. In the embodiments shown herein, and as best seen in FIG. 6, the bottom of the settling tank is slightly sloped, to promote sludge accumulation on one side of the tank, from where it is collected via outlets 68. As is apparent, setting tanks with designs other than those described herein may be used in the water treatment module.

In operation, mats that are to be cleaned are fed pile side up into the entrance of the apparatus. Attachment of a delivery platform to the apparatus facilitates inspection and pretreatment (if needed). The leading edge of the mat is inserted into the entrance, after which it will be conveyed through the apparatus by and on the conveying means.

In preferred embodiments the leading edge of the mat proceeds, immediately after the entrance into the apparatus, into a transverse trough, where the mat is soaked with water contained in the trough. This water may be water that was ejected by the wash and/or rinse nozzles, or it may come from elsewhere. The soaking of the mat in the trough will loosen some of the dirt, which can be washed away. The soaking will also begin the process of loosening dirt that is more firmly embedded in the pile, so that when the soaked portion of the mat reaches the wash and/or rinse nozzles, the dirt is more readily dislodged. Therefore, running the mat through the transverse trough prewashes the mat and presoaks the mat for the washing/rinsing stage.

After entering the apparatus, and after soaking of the mat in the transverse trough if performed, the mat is conveyed pile side up along at least one incline. Water flows down the incline, in the opposite direction. This water carries loosened dirt to the bottom of the incline, where the water and suspended dirt may be collected from the apparatus. The water is either disposed of or reused.

Because an incline is used during the washing and/or rinsing operation, it is beneficial to use some means to hold the mat to prevent it from sliding down the incline and bunching together.

On the incline a series of nozzles spray water, optionally containing chemical additives, at a high pressure onto the mat. The high pressure spray dislodges dirt that is embedded deep in the pile of the mat, and forces this dirt down the incline. The loosened dirt is also carried down the incline by the water as it flows downwards.

As the mat moves past the high pressure nozzles the dirt is dislodged from the pile and forced down the incline. Thus, as the mat passes the high pressure nozzles, the dirt contained in the mat is progressively dislodged from the pile and moved down the pile towards the trough if used, and ultimately to the trailing edge of the mat. The number of high pressure nozzles, and the types of solutions that they spray can be varied depending on the types of mats that are to be cleaned. The high pressure nozzles may wash the mat and/or rinse the mat after washing it.

After the mat has been washed and optionally rinsed, it is treated to an extraction operation to remove residual water. In a preferred embodiment extraction of the water is accomplished with air knives, which use a stream of high pressure air to force water from the pile. Other extraction means such as vacuums may also be used alternately or in addition.

When air knives are used, they are preferably used in series on an inclined portion of the mat, so that the water which is dislodged by the air knives will flow down the incline of the mat to wetter regions of the mat. Thus, as the mat passes the series of air knives, the water contained in the now cleaned mat is progressively dislodged from the pile and moved down the mat. In a particularly preferred embodiment, the incline of the mat is continuous from the extraction operation through to the wash and/or rinse operations, so that extracted water proceeds down the incline to wetter regions of the mat, into the trough if used, and ultimately off the trailing edge of the mat.

Water that is used in the apparatus may be collected in a collection tank. In preferred embodiments this water is clarified and reused in the apparatus. In these preferred embodiments the collection tank may be a mud tank which performs a primary separation of suspension of water and dirt particles. Clarified water from the mud tank is conveyed to a separation tank where it is further clarified to remove dirt particulates, before it is reused in the apparatus.

While the apparatus and method have been described in conjunction with the disclosed embodiments which are set forth in detail, it should be understood that this is by illustration only and the method and apparatus are not intended to be limited to these embodiments. On the contrary, this disclosure is intended to cover alternatives, modifications, and equivalents which will become apparent to those skilled in the art in view of this disclosure.

The invention claimed is:

1. An apparatus for washing a mat having a pile side and a backing comprising:

a) a housing having opposing sidewalls, a front end wall, a rear end wall, an entrance in the front end wall for receiving the mat pile side up and an exit in the rear end wall;

b) a conveying means for moving the mat through the apparatus, said conveying means extending from the entrance to a prewash module, a wash and/or rinse module, an extraction module and the exit and said conveying means having an inclined path with an incline of between about 30 and about 60 degrees from horizontal orientation, said inclined path extending from the entrance through the prewash module, through the wash and/or rinse module, through the extraction module and to a peak above the extraction module;

c) a plurality of stationary guide rods above the inclined path extending longitudinally in a direction of travel of the conveying means, configured to hold the mat flat as the mat moves up the inclined path;

d) said wash and/or rinse module comprising a plurality of high pressure nozzles positioned to spray water at 500 psi or greater onto the conveying means on the inclined path of the conveying means;

e) said extraction module comprising a plurality of air knives positioned to direct a stream of air onto the inclined path of the conveying means;

f) a transverse trough having a leading edge depending downwardly immediately inside the entrance, said trough situated before the inclined path of the conveying means to receive water that flows down from the inclined path, and comprising one or more openings therein sized for free flow of water therethrough directly into a collection tank below the one or more openings, said conveying means moving the mat through the transverse trough; and i) said plurality of guide rods extending into the transverse trough and configured to direct the mat downwards from the entrance into the transverse trough.

2. The apparatus of claim 1 wherein the inclined path has an incline of between about 40 and about 50 degrees from horizontal orientation.

3. The apparatus of claim 1 wherein the collection tank is under the entrance of the housing.

4. The apparatus of claim 3 further comprising a settling tank to receive water from the collection tank.

5. The apparatus of claim 4 wherein the settling tank is under the wash and/or rinse module.

6. The apparatus of claim 1 wherein the high pressure nozzles are rotating nozzles.

7. The apparatus of claim 1 wherein the apparatus is configured to receive the mat between the plurality of guide rods and the conveying means.

8. An apparatus for washing a mat having a pile side and a backing comprising:

a) a housing having opposing sidewalls, a front end wall, a rear end wall, an entrance in the front end wall for receiving the mat pile side up and an exit in the rear end wall;

b) a conveyor belt for moving the mat through the apparatus from the entrance to the exit, first through a prewash module, then through a wash and/or rinse module, then through an extraction module, said conveyor belt having a first inclined portion extending from the entrance through the prewash module and through the wash and/or rinse module, said first inclined portion having an incline of between about 30 and about 60 degrees from horizontal orientation and a second inclined portion after the wash and/or rinse module extending through the extraction module to a peak above the extraction module and having an incline of between about 30 and about 60 degrees from horizontal orientation;

c) a plurality of stationary guide rods above said first inclined portion extending longitudinally in a direction of travel of the conveyor belt, and configured to holding the mat flat as the mat moves up said first inclined portion;

d) said wash and/or rinse module comprising a plurality of high pressure nozzles positioned to spray water at greater than 500 psi onto the first inclined portion of the conveyor belt;

e) said prewash module comprising a transverse trough having a leading edge depending immediately downwardly immediately inside the entrance and situated at the bottom of the first inclined portion to receive water that flows down from the first inclined portion, said transverse trough comprising one or more openings therein sized for free flow of water therethrough directly into a mud tank below the one or more openings;

f) said extraction module comprising a plurality of air knives positioned to direct a stream of air onto the second inclined portion of the conveyor belt; and g) said plurality of guide rods extending into the transverse trough and configured to direct the mat downwards from the entrance into the transverse trough.

9. The apparatus of claim 8 wherein the first inclined portion has an incline of between about 40 and about 50 degrees from horizontal orientation.

10. The apparatus of claim 8 wherein the first and second inclined portions are continuous.

11. The apparatus of claim 8 wherein the mud tank is under the entrance.

12. The apparatus of claim 11 further comprising a settling tank under the wash and/or rinse module, that receives water from the mud tank.

13. The apparatus of claim 8 wherein the high pressure nozzles are rotating nozzles.

14. The apparatus of claim 8 wherein the apparatus is configured to receive the mat between the plurality of guide rods and the conveyor belt.

* * * * *